US009434177B2

(12) United States Patent
Yoneyama

(10) Patent No.: US 9,434,177 B2
(45) Date of Patent: Sep. 6, 2016

(54) PRINTING DEVICE

(71) Applicant: SEIKO EPSON CORPORATION, Tokyo (JP)

(72) Inventor: Tsutomu Yoneyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/221,813

(22) Filed: Mar. 21, 2014

(65) Prior Publication Data

US 2014/0292889 A1 Oct. 2, 2014

(30) Foreign Application Priority Data

Mar. 27, 2013 (JP) ..... 2013-065812

(51) Int. Cl.
*B41J 29/393* (2006.01)
*B41J 2/21* (2006.01)
*B41J 2/165* (2006.01)

(52) U.S. Cl.
CPC ..... *B41J 2/2142* (2013.01); *B41J 2/2146* (2013.01); *B41J 2002/16529* (2013.01)

(58) Field of Classification Search
CPC ..... B41J 2/2142; B41J 2/2146
See application file for complete search history.

(56) References Cited

U.S. PATENT DOCUMENTS

2003/0048469 A1* 3/2003 Hanson ..... 358/1.14
2005/0212845 A1* 9/2005 Shinkawa ..... 347/19

FOREIGN PATENT DOCUMENTS

JP 2007-008054 1/2007

* cited by examiner

*Primary Examiner* — Julian Huffman
(74) *Attorney, Agent, or Firm* — Workman Nydegger

(57) ABSTRACT

A printing device includes a transporter that transports a printing medium, a head that ejects ink onto the printing medium and forms an image, an inspector that inspects whether or not a dot of the image is omitted, and a controller that controls the transporter, the head, and the inspector. When the inspection of whether or not a dot is omitted is executed, the controller prints, on the printing medium, inspection result information that indicates whether or not the dot is omitted.

3 Claims, 5 Drawing Sheets

PRINTING DEVICE

BACKGROUND

1. Technical Field

The present invention relates to a printing device.

2. Related Art

A printing device that includes a transporter for transporting a printing medium such as roll paper and a head for ejecting ink onto the printing medium and forming an image is known. The printing device is an inkjet printer, for example.

The printing device may include an inspector for inspecting whether or not a dot of the image is omitted.

JP-A-2007-8054 is an example of related art.

If the inspector detects that a dot of the image is omitted, a user identifies a portion on which the dot is omitted. Specifically, the user visually searches, from the image formed on the printing medium, the portion on which the dot is omitted.

In this case, however, it takes time and efforts for the user and a new measure that is highly convenient for the user is requested to be taken.

SUMMARY

An advantage of some aspects of the invention is that it provides a printing device that is highly convenient for a user.

According to an aspect of the invention, a printing device includes a transporter that transports a printing medium, a head that ejects ink onto the printing medium and forms an image, an inspector that intermittently inspects whether or not a dot of the image is omitted, and a controller that controls the transporter, the head, and the inspector. When the inspection of whether or not a dot is omitted is executed, the controller prints, on the printing medium, inspection result information that indicates whether or not the dot is omitted.

Other features of the invention are clarified from the description of the present specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

At least the following matters are clarified from the description of the present specification and the accompanying drawings.

A printing device includes a transporter that transports a printing medium, a head that ejects ink onto the printing medium and forms an image, an inspector that intermittently inspects whether or not a dot of the image is omitted, and a controller that controls the transporter, the head, and the inspector.

When the inspection of whether or not a dot is omitted is executed, the controller prints, on the printing medium, inspection result information that indicates whether or not the dot is omitted.

The printing device that is highly convenient for a user can be achieved.

In addition, the controller may execute the inspection after executing a process of interrupting the transportation of the printing medium and a process of retracting the head positioned above the printing medium from a position above the printing medium. If a result of the inspection indicates that the dot is omitted, the controller may control the head retracted and execute a flushing operation. After the flushing operation, the controller may return the head to the position above the printing medium and print the inspection result information on the printing medium.

In this case, the convenience for the user can be further improved.

In addition, the controller may execute the inspection while executing an operation of forming the image. If a result of the inspection indicates that the dot is omitted, the controller may form a flushing pattern image on the printing medium and print the inspection result information on the printing medium.

In this case, the throughput of the printing can be improved, while the convenience for the user can be improved.

In addition, if the result of the inspection indicates that the dot is omitted, the controller may print the inspection result information and then form the flushing pattern image on a portion located on an upstream side in a transportation direction of the printing medium with respect to a portion on which the inspection result information is printed.

In this case, a range to be viewed by the user is narrow in order to search a portion on which the dot is omitted.

In addition, after terminating a process of forming the image on the printing medium, the controller may print, on the printing medium, information that indicates the number of times when inspection result information that indicates that a dot is omitted is printed on the printing medium.

In this case, the convenience for the user can be further improved.

In addition, the inspection result information may include character information.

In this case, the convenience for the user can be further improved.

Example of Outline Configuration of Printer 1

Figure 1:
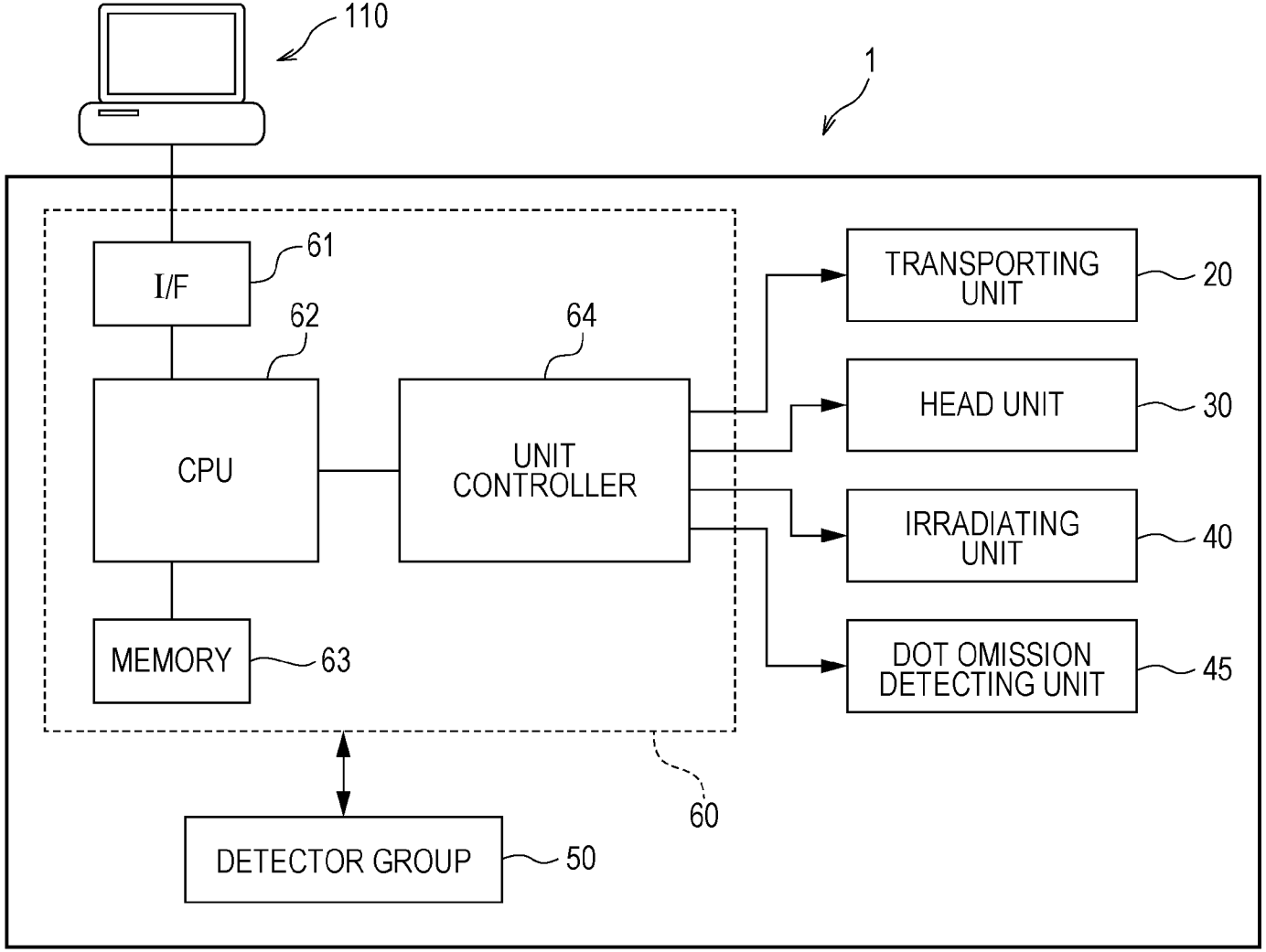
FIG. 1 is a block diagram illustrating an overall configuration of a printer.
Figure 2:
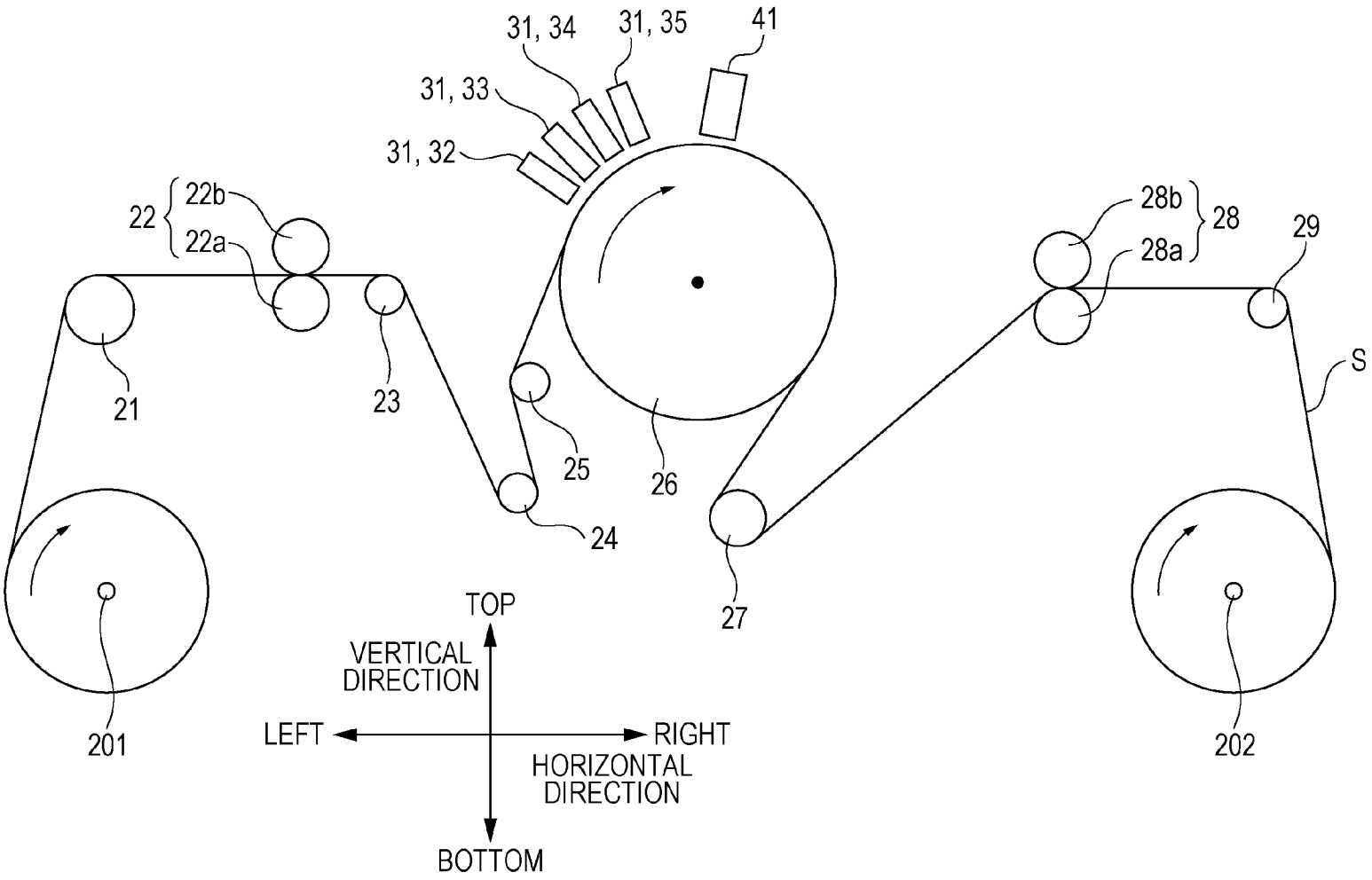
FIG. 2 is an outline diagram illustrating a transportation path including a printing region.

FIG. 1 is a block diagram illustrating an overall configuration of an inkjet printer (hereinafter merely referred to as a printer 1) as an example of the printing device. FIG. 2 is an outline diagram illustrating a transportation path including a printing region.

The printer 1 is a printing device that prints an image on a printing medium and is capable of communicating with a computer 110 that is an external device. In first and second embodiments, as an example of the printing medium on which an image is printed by the printer 1, a medium (roll-shaped medium, hereinafter specifically referred to as roll paper S (continuous paper)) such as paper wound in a roll shape is used.

In addition, the printer 1 according to the first embodiment is a so-called label printer. The printer 1 prints a plurality of labels (unit images) as an example of images (or repeatedly prints the same label).

A printer driver is installed in the computer 110. The printer driver is a program that causes a display device (not illustrated) to display a user interface and converts image data output from an application program into printing data. The printer driver is stored in a recording medium (computer-readable recording medium) such as a flexible disk (FD) or a CD-ROM. The printer driver may be downloaded into the computer 110 through the Internet. This program is made up of codes for achieving various functions.

Then, the computer 110 outputs, to the printer 1, the printing data corresponding to labels (unit images) to be printed in order to cause the printer 1 to print the labels (unit images).

The printer 1 according to the present embodiment is a device that ejects ultraviolet-curable ink (hereinafter referred to as UV ink) serving as an example of the ink and prints the labels (unit images) on the printing medium. The UV ink contains ultraviolet curable resin. When the UV ink is irradiated with ultraviolet (hereinafter referred to as UV), a photopolymerization reaction occurs in the ultraviolet curable resin and thus the UV ink is cured by the irradiation with the UV. The printer 1 according to the present embodiment prints an image using the UV ink of four colors, cyan, magenta, yellow, and black.

The printer 1 includes a transporting unit 20 serving as an example of the transporter, a head unit 30, an irradiating unit 40, a dot omission detecting unit 45 serving as an example of the inspector, a detector group 50 (excluding the dot omission detecting unit 45), and a controller 60 serving as an example of the controller. When the printer 1 receives the printing data from the computer 110 that is the external device, the printer 1 causes the controller 60 to control the units (the transporting unit 20, the head unit 30, the irradiating unit 40, and the dot omission detecting unit 45) and thereby prints the labels (unit images) on the roll paper S in accordance with the printing data. In other words, the controller 60 controls the units based on the printing data received from the computer 110 and prints the labels (unit images) on the roll paper S. The inside of the printer 1 is monitored by the detector group 50, and the detector group 50 outputs detection results to the controller 60. The controller 60 controls the units based on the detection results output from the detector group 50.

The transporting unit 20 transports the roll paper S along the transportation path set in advance. As illustrated in FIG. 2, the transporting unit 20 has a feeding shaft 201, a relay roller 21, a first transporting roller 22, a relay roller 23, a reversing roller 24, a contact roller 25, a transporting drum 26, a tension roller 27, a second transporting roller 28, a tension roller 29, and a winding drive shaft 202. The roll paper S is wound around the feeding shaft 201 and rotatably held by the feeding shaft 201. The winding drive shaft 202 winds the roll paper S that has passed through the tension roller 29.

The relay roller 21 rolls, from a lower side (lower left side of FIG. 2), the roll paper S fed from the feeding shaft 201 and transports the roll paper S to the right side of FIG. 2 in a horizontal direction.

The first transporting roller 22 includes a first driving roller 22*a* and a first driven roller 22*b*. The first driving roller 22*a* is driven by a motor (not illustrated). The first driven roller 22*b* is arranged opposite to the first driving roller 22*a* with respect to the roll paper S. The position and speed of the roll paper S are controlled by the driving of the first driving roller 22*a*.

The relay roller 23 rolls, in the horizontal direction from the left side, the roll paper S that has passed through the first transporting roller 22. Then, the relay roller 23 transports the roll paper S to the lower right side.

The reversing roller 24 reverses a transportation direction of the roll paper S that has passed through the relay roller 23.

The relay roller 25 rolls, in a vertical direction from the lower side, the roll paper S that has passed through the reversing roller 24. Then, the relay roller 25 transports the roll paper S to the transporting drum 26.

The transporting drum 26 is a cylindrical transporting member. The transporting drum 26 holds the roll paper S on a circumferential surface of the transporting drum 26 and transports the roll paper S in the transportation direction. The transporting drum 26 is arranged opposite to heads 31 (described later) and an irradiating unit 41 (described later) with respect to the roll paper S. The roll paper S tightly contacts the transporting drum 26 and is transported by the transporting drum 26, while predetermined tension is given to the roll paper S.

The tension roller 27 is arranged on the lower right side of the transporting drum 26. The tension roller 27 reverses the transportation direction of the roll paper S that has passed through the transporting drum 26. Then, the tension roller 27 transports the roll paper S to the second transporting roller 28.

The second transporting roller 28 includes a second driving roller 28*a* and a second driven roller 28*b*. The second driving roller 28*a* is driven by a motor (not illustrated). The second driven roller 28*b* is arranged opposite to the second driving roller 28*a* with respect to the roll paper S. The second transporting roller 28 transports a portion of the roll paper S after images are printed by the heads 31 on the portion of the roll paper S.

The tension roller 29 rolls, in the horizontal direction from the left side, the roll paper S that has passed through the second transporting roller 28. Then, the tension roller 29 transports the roll paper S to the winding drive shaft 202 located on the lower side in the vertical direction.

In this manner, the transportation path for the transportation of the roll paper S is formed by sequentially moving the roll paper S through the rollers.

The head unit 30 ejects the UV ink onto the roll paper S. The head unit 30 forms dots on the roll paper S and prints labels (unit images) on the roll paper S by ejecting, from the heads 31, the UV ink onto the roll paper S that is being transported in the transportation direction.

The heads 31 of the head unit 30 included in the printer 1 according to the present embodiment are each capable of simultaneously forming dots across the entire width of the roll paper S. Thus, the heads 31 are so-called line heads. The heads 31 are each formed in a long shape in a paper width direction (intersecting the surface of the sheet of FIG. 2) intersecting the transportation direction and each have nozzles arranged in the paper width direction. The heads 31 eject the UV ink from the nozzles onto the roll paper S transported by the transporting unit 20 and sequentially (repeatedly) print raster lines (this operation causes the plurality of raster lines to be arranged in the transportation direction).

The nozzles have piezoelectric elements (not illustrated) serving as driving elements for ejecting ink droplets. When a voltage is applied between electrodes arranged on both ends of each of the piezoelectric elements for a predetermined time period, the piezoelectric elements are extended based on the time period for the application of the voltage and thereby change shapes of side walls (vibrating plates) of flow paths for the UV ink. This operation increases and reduces the volumes of the flow paths for the UV ink based on the extension and contraction of the piezoelectric elements. The ink corresponding to the increases and reductions in the volumes of the flow paths is ejected as ink droplets from the nozzles.

As described above, in the present embodiment, the UV ink of the four colors is used as the UV ink in order to form labels (unit images). As illustrated in FIG. 2, the heads 31 are arranged opposite to the circumferential surface of the transporting drum 26 and are a cyan ink head 32 for ejecting cyan UV ink, a magenta ink head 33 for ejecting magenta UV ink, a yellow ink head 34 for ejecting yellow UV ink, and a black ink head 35 for ejecting black UV ink. The cyan ink head 32, the magenta ink head 33, the yellow ink head 34, and the black ink head 35 are arranged in order from the upstream side in the transportation direction.

The heads 31 are capable of moving in the paper width direction (intersecting the surface of the sheet of FIG. 2). Specifically, the heads 31 are positioned above the roll paper S (or face the roll paper S) during the printing on the roll paper S, but can be retracted from the roll paper S.

A cleaner (not illustrated) for cleaning the heads 31 in order for the heads 31 to recovery from a failure of the ejection and an ink receiver (not illustrated) for receiving ink ejected by the flushing operation or the like are provided in a space into which the heads 31 are retracted. After the heads 31 are retracted and cleaned for recovery from a failure of the ejection, the heads 31 are positioned above the ink receiver (or positioned opposite to the ink receiver) and executes flushing so as to eject the ink toward the ink receiver.

The irradiating unit 40 irradiates the UV ink landing on the roll paper S with the UV. Dots formed on the roll paper S are irradiated by the irradiating unit 40 with the UV and thereby cured. The irradiating unit 40 according to the present embodiment has an irradiator 41. The irradiator 41 has a lamp (that is a metal halide lamp, a mercury lamp, or the like) or an LED as a light source for irradiation with the UV.

The irradiator 41 is arranged on a downstream side with respect to the black ink unit 35 in the transportation direction. In other words, the irradiator 41 is arranged on the downstream side with respect to the head unit 30 in the transportation direction. The irradiator 41 irradiates, with the UV, the unit images (dots) formed on the roll paper S by the cyan ink head 32, the magenta ink head 33, the yellow ink unit 34, and the black ink unit 35 and thereby cures the dots.

The dot omission detecting unit 45 is configured to inspect whether or not a dot of the labels (unit images) is omitted (whether or not a white stripe appears as the omission of the dot, for example) and detect a failure of the labels (unit images). In the present embodiment, the dot omission detecting unit 45 uses an NSA method (detection method to be performed based on residual vibration of the vibrating plate after application of waveforms for ink ejection) described in Japanese Patent No. 3794431 to detect where or not a failure of the ink ejection occurs and thereby inspect (detect) whether or not a dot is omitted. The present embodiment, however, is not limited to this method. Any method may be applied as long as the method is to inspect whether or not a dot of the labels (unit images) is omitted. For example, a method for causing a light receiving sensor to detect whether or not the UV ink ejected by the heads 31 blocks laser light and detecting a failure of the ink ejection (or the omission of a dot) based on a result of the detection by the light receiving sensor may be used. Alternatively, a method for detecting (inspecting whether or not a dot is omitted) a failure of the ink ejection based on a change in a capacity value for the ink ejection may be used.

The detector group 50 includes a rotary encoder. The rotary encoder detects a rotational amount of the first driving roller 22*a* and a rotational amount of the second driving roller 28*a*. The amount of the medium transported can be detected based on results of the detection by the rotary encoder.

The controller 60 is a control unit (controller) for controlling the printer 1. The controller 60 includes an interface unit 61, a CPU 62, a memory 63, and a unit controller 64. The interface unit 61 transmits and receives data between the printer 1 and the computer 110 that is the external device. The CPU 62 is an arithmetic processing device that controls the overall printer 1. The memory 63 secures a region for storing a program of the CPU 62, a work region, and the like and includes storage elements such as a RAM, an EEPROM, and the like. The CPU 62 controls the units 20, 30, 40, and 45 through the unit controller 64 in accordance with the program stored in the memory 63.

Printing Process

Figure 3:
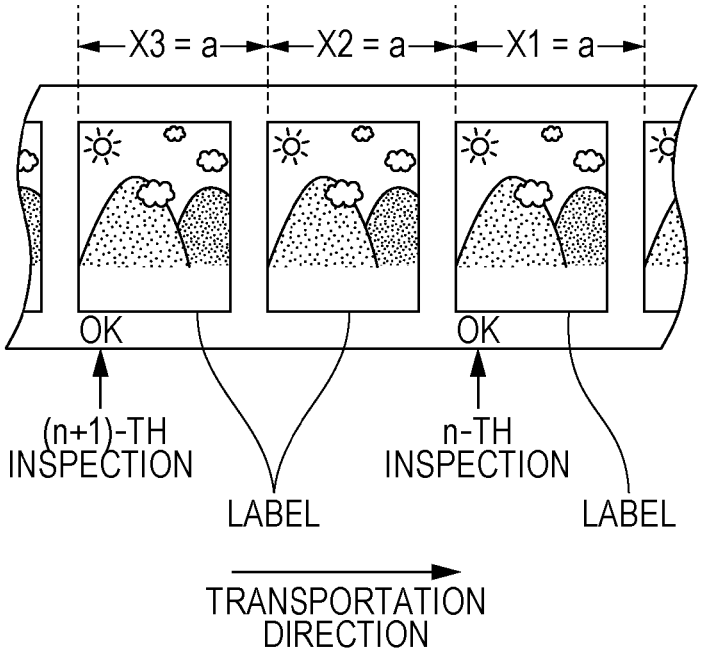
FIG. 3 is a schematic diagram illustrating a state in which labels (unit images) are printed on roll paper.

An example of a printing process to be executed by the printer 1 is described with reference to FIG. 3. FIG. 3 is a schematic diagram illustrating a state in which labels (unit images) are printed on the roll paper S.

The printing process is mainly achieved by the controller 60. Especially, in the present embodiment, the printing process is achieved by causing the CPU 62 to execute the program stored in the memory 63. The program is made up of codes for execution of various operations described below.

When the printing process is to be started by the printer 1, the roll paper S is placed on the transportation path while being held on the circumferential surface of the transporting drum 26. Then, tension is given to the roll paper S by the feeding shaft 201, the winding drive shaft 202, and torque output from the second transporting roller 28. Specifically, at a portion at which the roll paper S is fed, predetermined tension is given to the roll paper S by brake torque of the feeding shaft 201 based on the diameter of the roll paper S. At a portion corresponding to the printing region, the tension roller 27 detects the tension of the roll paper S, and torque of the motor (not illustrated) for the second transporting roller 28 is controlled so that the tension is a predetermined value. At a portion at which the roll paper S is wound, the tension roller 29 detects the tension of the roll paper S, and torque of a motor (not illustrated) for the winding drive shaft 202 is controlled so that the tension is a predetermined value. The tension is determined based on the diameter of the roll paper S.

When the printer 1 receives the printing data from the computer 110 (or receives a job), the controller 60 rotates the motor (not illustrated) for the first transporting roller 22. The roll paper S is transported in the transportation direction by a rotation of the first transporting roller 22 in a state in which the tension is given to the roll paper S as described above.

The transporting drum 26 is rotated by force of friction with the roll paper S in accordance with the transportation of the roll paper S in the direction (transportation direction)

indicated by an arrow. The roll paper S located on the circumferential surface of the transporting drum 26 is transported according to the rotation of the transporting drum 26 in the transportation direction. Note that the roll paper S that is being transported tightly contacts the transporting drum 26. In the present embodiment, the positions of the heads 31 during the printing are fixed, and the roll paper S is transported in the transportation direction and thereby moves relative to the heads 31 in the transportation direction.

The heads 31 of the head unit 30 eject the UV ink onto the roll paper S transported by the transporting unit 20 based on the printing data and form the labels (unit images) on the roll paper S. When the formed labels (unit images) are transported and thereby face the irradiator 41, the irradiating unit 40 irradiates the labels (unit images) with the UV and thereby cures the UV ink on the roll paper S.

The controller 60 (dot omission detecting unit 45) intermittently (periodically in the present embodiment) inspects whether or not a dot of the labels (unit images) is omitted.

Specifically, the controller 60 interrupts the printing process (label formation process) when whether or not a dot is omitted is to be inspected. More specifically, the controller 60 executes a process of interrupting the transportation of the roll paper S and a process of retracting the heads 31 positioned above the roll paper S from positions above the roll paper S. Then, the dot omission detecting unit 45 executes the dot omission inspection using the aforementioned NSA method (this example assumes that the omission of a dot is not detected by the dot omission inspection, and an example in which the omission of a dot is detected is described later).

Then, the controller 60 prints, on the roll paper S, inspection result information that indicates whether or not a dot is omitted at this time (or when the dot omission inspection is executed). After the dot omission inspection, the controller 60 returns the heads 31 to the positions above the roll paper S and restarts the printing of labels (unit images). The controller 60, however, prints inspection result information on the roll paper S after returning of the heads 31 to the positions above the roll paper S and before the restart of the printing of the labels (unit images).

In the present embodiment, the inspection result information that includes character information is printed. Specifically, when a dot is omitted, a character "NG" that indicates "fail" is printed. When a dot is not omitted, a character "OK" that indicates "pass" is printed (in this example, the character "OK" is printed).

As illustrated in FIG. 3, by the aforementioned process, the plurality of labels (unit images) are printed on the roll paper S and the inspection result information is intermittently printed on the roll paper S.

In the present embodiment, the controller 60 (heads 31) prints the labels (unit images) so that the labels (unit images) are regularly arranged. Specifically, as illustrated in FIG. 3, the labels (unit images) are formed so that differences (or pitches in the transportation direction) X1, X2, X3, . . . between positions of adjacent pairs of the labels (unit images) printed on the roll paper S are the same value a.

Process to be Executed if Omission of Dot is Detected

Figure 4:
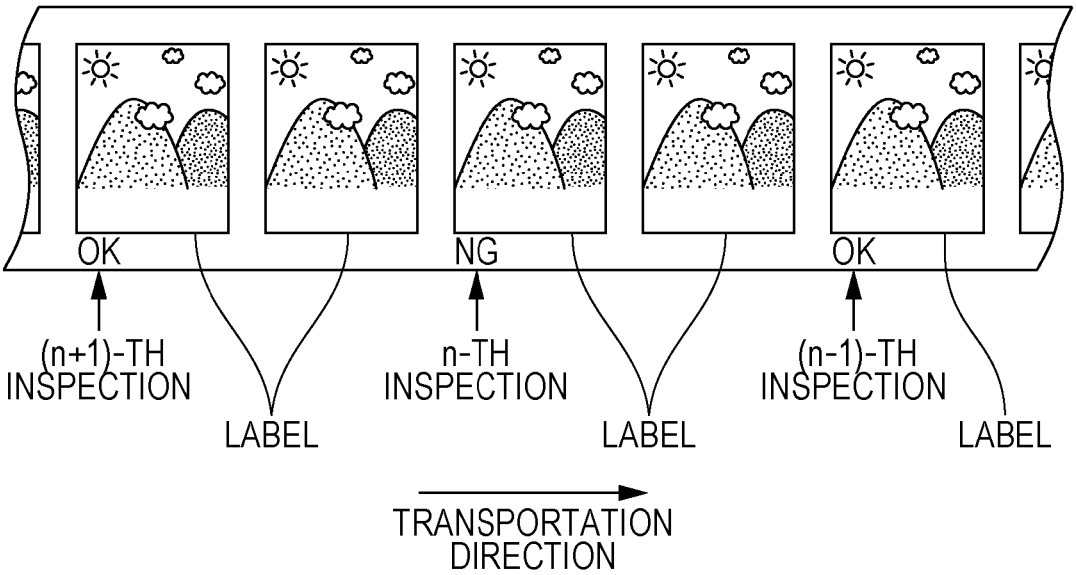
FIG. 4 is a schematic diagram illustrating states of labels (unit images) and the like on the roll paper when the omission of a dot is detected.

Next, a process to be executed if the omission of a dot is detected by the dot omission detecting unit 45 is described with reference to FIG. 4. FIG. 4 is a schematic diagram corresponding to FIG. 3 and illustrates states of labels (unit images) and the like on the roll paper S if the omission of a dot is detected.

As described above, the controller 60 interrupts the printing process (label formation process) when the dot omission inspection is to be inspected. Specifically, the controller 60 executes the process of interrupting the transportation of the roll paper S and the process of retracting the heads 31 positioned above the roll paper S from the positions above the roll paper S. Then, the dot omission detecting unit 45 executes the dot omission inspection using the NSA method. If the omission of a dot is detected (or a result of the inspection indicates that the dot is omitted), the following process is executed.

Specifically, after the controller 60 causes the cleaner to clean the heads 31 for recovery from a failure of the ejection, the controller 60 controls the heads 31 retracted and executes the flushing operation for the heads 31. Thus, the heads 31 executes the flushing so as to eject the ink toward the aforementioned ink receiver.

After the flushing operation, the controller 60 returns the heads 31 to the positions above the roll paper S and restarts the printing of labels (unit images) after the returning of the heads 31. The controller 60 prints the inspection result information after the returning of the heads 31 to the positions above the roll paper S and before the restart of the printing of the labels (unit images). In this example, a dot is omitted and the character "NG" is printed.

As illustrated in FIG. 4, by the aforementioned process, the plurality of labels (unit images) are formed on the roll paper S and the inspection result information is intermittently printed on the roll paper S.

FIG. 4 illustrates an example in which the omission of a dot is not detected in (n−1)-th dot omission inspection, the omission of a dot is detected in n-th dot omission inspection, and the omission of a dot is not detected in (n+1)-th dot omission inspection due to recovery, caused by the flushing operation, from a failure of the ejection after the n-th dot omission inspection.

Printer 1 According to Second Embodiment

Next, a printing process to be executed by the printer 1 according to a second embodiment is described and compared with the printing process to be executed by the aforementioned printer 1 (hereinafter referred to as the printer 1 according to the first embodiment).

The printing process is mainly achieved by the controller 60. Especially, in the second embodiment, the printing process is achieved by causing the CPU 62 to execute a program stored in the memory 63. The program is made up of codes for execution of various operations described below.

Differences Between Configurations

First, differences between the configuration of the printer 1 according to the second embodiment and the configuration of the printer 1 according to the first embodiment are described.

As described above, in the printer 1 according to the first embodiment, the heads 31 can move in the paper width direction (intersecting the surface of the sheet of FIG. 2) and be retracted from the positions above the roll paper S. In the printer 1 according to the second embodiment, however, the heads 31 are not retracted from the positions above the roll paper S.

In the second embodiment, the dot omission inspection is executed using the NSA method, while the heads 31 are positioned above the roll paper S. Since the heads 31 are not retracted from the positions above the roll paper S, the controller 60 executes the dot omission inspection (but intermittently (periodically) executes the dot omission inspection in the same manner as the first embodiment) while executing the operation of forming labels (unit images).

The printer 1 according to the first embodiment includes the ink receiver located in the space into which the heads 31 are retracted. The printer 1 according to the second embodiment, however, does not include the ink receiver. Thus, if the omission of a dot is detected, the controller 60 according to the second embodiment controls the heads 31 positioned above the roll paper S and executes a flushing operation (described later) so as to cause the heads 31 to eject the ink toward the roll paper S.

Printing Process

An example of a printing process to be executed by the printer 1 according to the second embodiment is described below with reference to FIG. 3.

When the printer 1 receives the printing data from the computer 110 (or receives a job), the controller 60 rotates the motor (not illustrated) for the first transporting roller 22. In a state in which the tension is given to the roll paper S as described above, the first transporting roller 22 rotates and thereby transports the roll paper S in the transportation direction.

Then, the heads 31 of the head unit 30 eject the UV ink onto the roll paper S transported by the transporting unit 20 and form labels (unit images) on the roll paper S based on the printing data. When the formed labels are transported and thereby face the irradiator 41, the irradiating unit 40 irradiates the labels (unit images) with the UV and thereby cures the UV ink on the roll paper S.

In addition, the controller 60 (dot omission detecting unit 45) intermittently (periodically in the present embodiment) inspects whether or not a dot of the labels (unit images) is omitted.

Specifically, when the dot omission inspection is to be executed, the controller 60 executes the dot omission inspection using the NSA method while executing the operation (printing process) of forming labels (unit images) (this example assumes that the omission of a dot is not detected by the dot omission inspection, and an example in which the omission of a dot is detected is described later).

Then, the controller 60 prints, on the roll paper S, inspection result information indicating whether or not a dot is omitted at this time (or when the dot omission inspection is executed).

In the second embodiment, the inspection result information is printed and includes character information. Specifically, when a dot is omitted, the character "NG" is printed. When a dot is not omitted, the character "OK" is printed (in this example, the character "OK" is printed).

As illustrated in FIG. 3, by the aforementioned process, the plurality of labels are printed on the roll paper S and the inspection result information is intermittently printed on the roll paper S.

In the second embodiment, the controller 60 (heads 31) prints the labels (unit images) so that the labels (unit images) are regularly arranged. Specifically, as illustrated in FIG. 3, the labels (unit images) are formed so that differences (or pitches in the transportation direction) X1, X2, X3, . . . between positions of adjacent pairs of the labels (unit images) printed on the roll paper S are the same value a.

Process to be Executed if Omission of Dot is Detected

Figure 5:
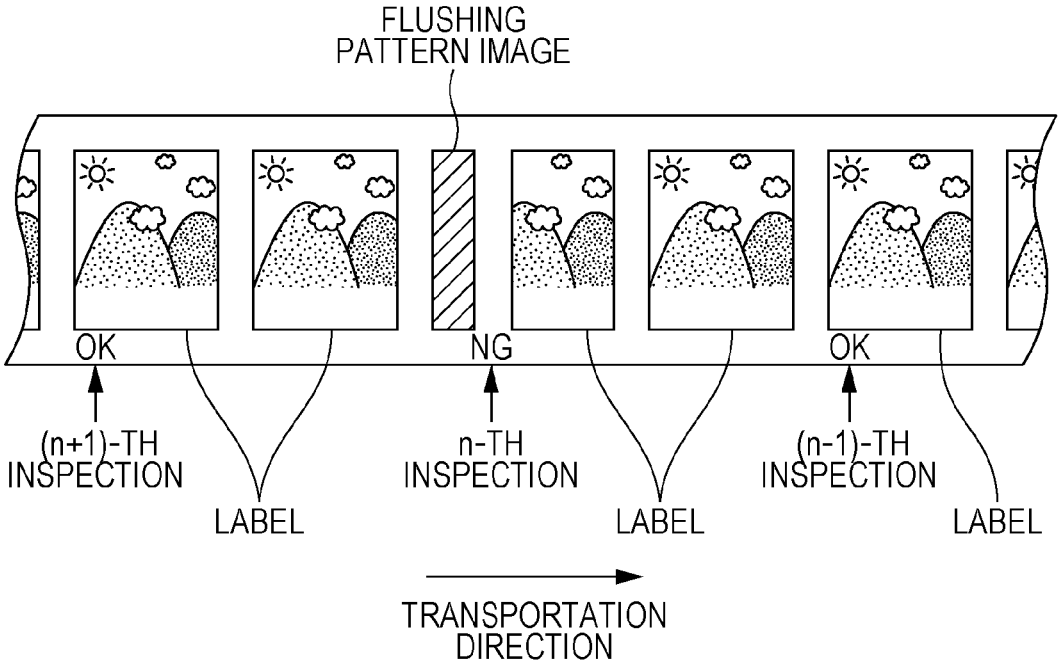
FIG. 5 is a schematic diagram illustrating states of labels (unit images) and the like on the roll paper when the omission of a dot is detected in a second embodiment.

Next, a process to be executed if the omission of a dot is detected by the dot omission detecting unit 45 is described with reference to FIG. 5. FIG. 5 is a schematic diagram corresponding to FIG. 4 and illustrates states of labels (unit images) and the like if the omission of a dot is detected in the second embodiment.

As described above, when the dot omission inspection is to be executed, the controller 60 (dot omission detecting unit 45) executes the dot omission inspection using the NSA method while executing the operation (printing process) of forming labels (unit images). However, if the omission of a dot is detected (or a result of the inspection indicates that the dot is omitted), the following process is executed.

Specifically, the controller 60 prints the inspection result information on the roll paper S and forms a flushing pattern image on the roll paper S. In the present embodiment, after the inspection result information is printed, the flushing pattern image is printed on a portion located on the upstream side in the transportation direction of the roll paper S with respect to a portion on which the inspection result information is printed.

First, the controller 60 prints the inspection result information on the roll paper S. In this example, a dot is omitted and thus the character "NG" (refer to the n-th dot omission inspection in FIG. 5) is printed. As illustrated in FIG. 5, the operation of forming labels (unit images) is interrupted during the execution of the operation.

Next, the controller 60 executes the flushing operation for the heads 31. Thus, the heads 31 execute flushing so as to eject the ink toward the roll paper S. Specifically, the controller 60 (heads 31) forms the flushing pattern image on the roll paper S as illustrated in FIG. 5. The flushing pattern image is an image formed on the roll paper S by executing the flushing in order to cause the heads 31 to recover from nozzle clogging. The flushing pattern image includes a pattern suitable to recover from the nozzle clogging.

By the aforementioned process, the plurality of labels (unit images) are formed on the roll paper S and the inspection result information is intermittently printed on the roll paper S as illustrated in FIG. 5.

FIG. 5 illustrates an example in which the omission of a dot is not detected in (n−1)-th dot omission inspection, the omission of a dot is detected in n-th dot omission inspection, and the omission of a dot is not detected in (n+1)-th dot omission inspection due to recovery, caused by the flushing operation, from a failure of the ejection after the n-th dot omission inspection.

Effectiveness of Printer 1 According to Embodiments

As described above, the printer 1 according to the embodiments (first and second embodiments) includes the transporting unit 20 that transports the roll paper S, the heads 31 that eject the UV ink onto the roll paper S and form labels (unit images), the dot omission detecting unit 45 that intermittently inspects whether or not a dot of the labels (unit images) is omitted, and the controller 60 that controls the transporting unit 20, the heads 31, and the dot omission detecting unit 45. When the inspection of whether or not a dot is omitted is executed, the controller 60 prints, on the roll paper S, the inspection result information (information of the character "OK" or "NG") indicating whether or not the dot is omitted. Thus, the printer 1 that is highly convenient for the user can be achieved.

As described above, if the omission of a dot of labels (unit images) is detected by the dot omission detecting unit 45, the user identifies a portion on which the dot is omitted. Specifically, the user visually searches, from the labels (unit images) formed on the roll paper S, the portion on which the dot is omitted.

In this case, however, it takes time and efforts for the user and a new measure that is highly convenient for the user is requested to be taken.

On the other hand, the printer 1 according to the embodiments supports the request. In the embodiments, the inspection result information (information of the character "OK" or "NG") that indicates whether or not a dot is omitted is printed on the roll paper S when the dot omission inspection is executed. Thus, if the user views a range (range located between a certain portion on which the character "NG" is printed in the n-th dot omission inspection and another portion on which the character "OK" is printed in the (n−1)-th dot omission inspection in each of the examples illustrated in FIGS. 4 and 5) located between a certain portion on which the character "NG" is printed and another portion that is located on the downstream side with respect to the certain portion in the transportation direction and closest to the certain portion among portions on which the character "OK" is printed, and the user searches a portion on which a dot is omitted on the roll paper S, the user can appropriately find the portion on which the dot is omitted on the roll paper S. Thus, user's time and efforts are reduced, and the printer 1 that is highly convenient for the user is achieved.

In the first embodiment, the controller 60 executes the dot omission inspection after executing the process of interrupting the transportation of the roll paper S and the process of retracting the heads 31 positioned above the roll paper S from the positions above the roll paper S. If a result of the inspection indicates that a dot is omitted, the controller 60 controls the heads 31 retracted and executes the flushing operation. After that, the controller 60 returns the heads 31 to the positions above the roll paper S and prints the inspection result information on the roll paper S.

Thus, it is not necessary to form the flushing pattern image on the roll paper S, unlike the second embodiment, and the inspection result information (information of the characters "OK" and "NG") can be regularly arranged (at regular intervals) on the roll paper S as illustrated in FIGS. 3 and 4. Thus, the user can easily visually confirm the inspection result information (information of the characters "OK" and "NG") (or easily find the character "NG") and the convenience for the user can be improved.

In the second embodiment, the controller 60 executes the dot omission inspection while executing the operation of forming labels (unit images). If a result of the inspection indicates that a dot is omitted, the controller 60 forms the flushing pattern image on the roll paper S and prints the inspection result information on the roll paper S.

Thus, it is not necessary to retract the heads 31 (or interrupt the printing in order to execute the inspection), unlike the first embodiment. Thus, the throughput of the printing can be improved, while the convenient for the user can be improved.

Other Embodiments

The aforementioned embodiments make it easy to understand the invention and shall not be interpreted to limit the scope of the invention. The invention may be changed and modified without departing from the spirit of the invention and may include equivalents of the changes and modifications. Especially, the following embodiment is included in the invention.

In the aforementioned embodiments, the roll paper S is used as an example of the printing medium. The printing medium, however, is not limited to paper. For example, the printing medium may be a film or a cloth.

In the aforementioned embodiments, the UV ink is used as an example of the ink. The ink, however, is not limited to the UV ink and may be other ink.

In the aforementioned embodiments, the cylindrical member (or the transporting drum 26) with the curved surface is used as an example of the member that is arranged opposite to the heads 31 and holds the roll paper S. The member that is arranged opposite to the heads 31 and holds the roll paper S, however, is not limited to the cylindrical member and may be a member with a flat surface.

In the aforementioned embodiments, the inspection result information includes the character information. The inspection result information is not limited to this. For example, the inspection result information may be symbols "✓" and "x" and may not include the character information.

However, the aforementioned embodiments are desirable since the user easily understands the inspection result information and the convenience for the user is improved.

In the second embodiment, if a result of the inspection indicates that a dot is omitted, the controller 60 prints the inspection result information and then forms the flushing pattern image on a portion located on the upstream side in the transportation direction of the roll paper S with respect to a portion on which the inspection result information is printed. The second embodiment, however, is not limited to this. For example, as illustrated in FIG. 6, after the flushing pattern image is printed, the result of the inspection may be formed on a portion located on the upstream side in the transportation direction of the roll paper S with respect to the portion on which the flushing pattern image is printed.

Figure 6:
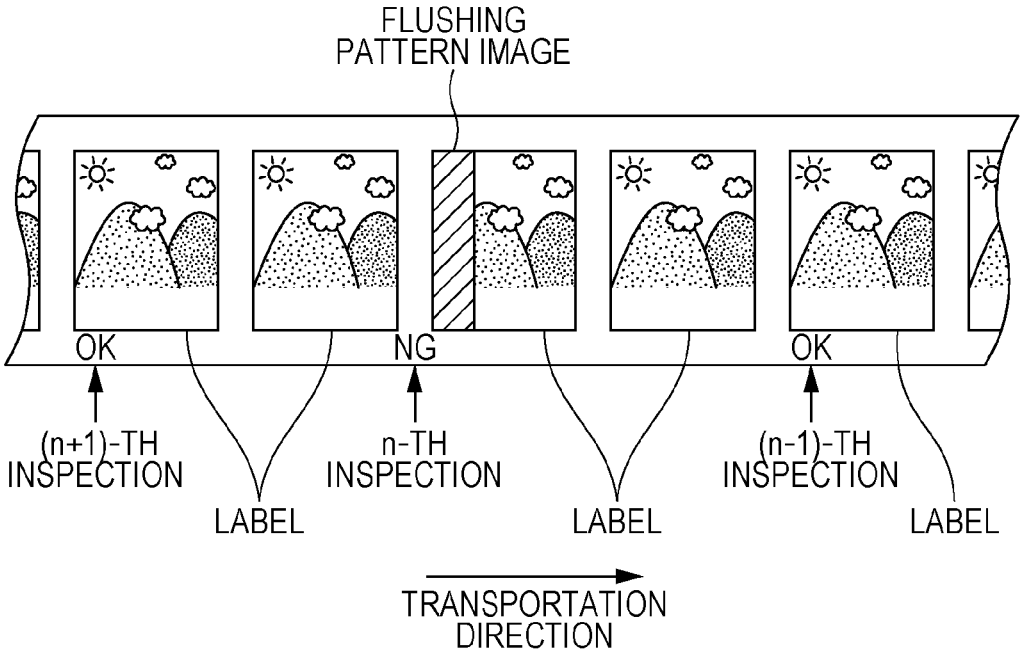
FIG. 6 is a schematic diagram illustrating states of labels (unit images) and the like on the roll paper when the omission of a dot is detected in a modified example of the second embodiment.

As is understood by comparing FIG. 5 with FIG. 6, a range to be viewed by the user in order to search a portion on which a dot is omitted or a range located between a certain portion on which the character "NG" is printed and a portion that is located on the downstream side with respect to the certain portion in the transportation direction and closest to the certain portion among portions on which the character "OK" is printed is narrower in the example (illustrated in FIG. 5) described in the second embodiment than the example illustrated in FIG. 6. Regarding this feature, the second embodiment is more desirable than the example illustrated in FIG. 6.

Since the inspection result information is printed after the flushing in the example illustrated in FIG. 6, a possibility that a dot is omitted from the inspection result information or a white stripe is formed in the inspection result information is lower than the second embodiment (note that even if a dot is omitted from the inspection result information or a white stripe is formed in the inspection result information, the functionality of the inspection result information is not deteriorated). Regarding this feature, the example illustrated in FIG. 6 is more desirable than the second embodiment.

Figure 7:
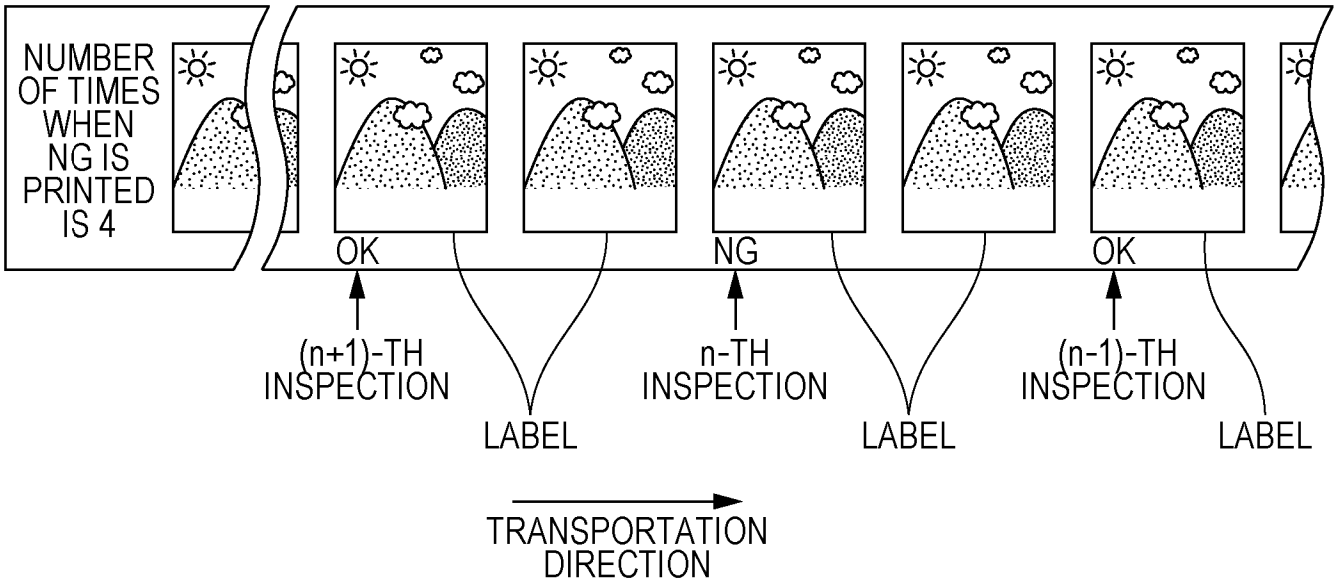
FIG. 7 is a schematic diagram illustrating states of labels (unit images) and the like on the roll paper when the omission of a dot is detected in another embodiment.

As illustrated in FIG. 7, after terminating the process of forming labels (unit images) on the roll paper S, the controller 60 (heads 31) may print, on the roll paper S, number information that indicates the number of times when inspection result information (or the character "NG") that indicates that a dot is omitted is printed. Specifically, after completing the printing of labels (unit images) on the roll paper S, the controller 60 (heads 31) may print the number information on an end portion of the roll paper S.

In this case, when a portion on which a dot is omitted is to be searched by the user after the completion of the printing of labels (unit images), the amount of information on a range to be viewed by the user increases. Thus, the convenience for the user is improved.

The entire disclosure of Japanese Patent Application No. 2013-065812, filed Mar. 27, 2013 is expressly incorporated by reference herein.

What is claimed is:

1. A printing device comprising:

a transporter that transports a printing medium;

a head that ejects ink onto the printing medium and forms an image;

an inspector that periodically inspects whether or not a dot of the image is omitted; and a controller that controls the transporter, the head, and the inspector, wherein when the inspection of whether or not a dot is omitted is executed, the controller prints, on the printing medium adjacent to the printed image, inspection result information that indicates whether or not the dot is omitted, wherein the controller executes the inspection after executing a process of interrupting the transportation of the printing medium and a process of retracting the head positioned above the printing medium from a position above the printing medium, wherein if a result of the inspection indicates that a dot is omitted, the controller controls the head retracted and executes a flushing operation, and wherein after the flushing operation, the controller returns the head to the position above the printing medium and prints the inspection result information on the printing medium.

2. The printing device according to claim 1, wherein after terminating a process of forming the image on the printing medium, the controller prints, on the printing medium, information that indicates the number of times when inspection result information that indicates that a dot is omitted is printed on the printing medium.

3. The printing device according to claim 1, wherein the inspection result information includes character information.

* * * * *